US012116704B2

(12) United States Patent
Bahlmann

(10) Patent No.: US 12,116,704 B2
(45) Date of Patent: Oct. 15, 2024

(54) METHOD AT A SPINNING MACHINE AND SPINNING MACHINE

(71) Applicant: MASCHINENFABRIK RIETER AG, Winterthur (CH)

(72) Inventor: Bernd Bahlmann, Schrobenhausen (DE)

(73) Assignee: MASCHINENFABRIK RIETER AG, Winterthur (CH)

( * ) Notice: Subject to any disclaimer, the term of this patent is extended or adjusted under 35 U.S.C. 154(b) by 22 days.

(21) Appl. No.: 18/156,009

(22) Filed: Jan. 18, 2023

(65) Prior Publication Data

US 2023/0228005 A1 Jul. 20, 2023

(30) Foreign Application Priority Data

Jan. 19, 2022 (DE) ..... 10 2022 101 155.0

(51) Int. Cl.

| | |
|---|---|
| ***D01H 13/32*** | (2006.01) |
| ***B65H 67/06*** | (2006.01) |
| ***D01H 3/26*** | (2006.01) |
| ***D01H 13/14*** | (2006.01) |

(52) U.S. Cl.

CPC ..... *D01H 13/32* (2013.01); *B65H 67/063* (2013.01); *D01H 3/26* (2013.01); *D01H 13/14* (2013.01)

(58) Field of Classification Search

CPC ..... D01H 3/26; D01H 13/14; D01H 13/32; B65H 67/06; B65H 67/063; B65H 2511/40

See application file for complete search history.

(56) References Cited

U.S. PATENT DOCUMENTS 4,660,370 A * 4/1987 Matsui ..... B65H 67/063 57/264
4,838,019 A * 6/1989 Ueda ..... D01H 9/187 57/264
5,040,660 A * 8/1991 Ohta ..... B65H 67/063 209/927
5,107,667 A * 4/1992 Tone ..... D01H 13/32 57/264

(Continued)

FOREIGN PATENT DOCUMENTS

CH 686156 A5 * 1/1996 ..... B65H 67/063
DE 39 11 799 A1 10/1990

(Continued)

OTHER PUBLICATIONS

German Patent Office Search Report, Nov. 18, 2022.
EPO Search Report, Jun. 7, 2023.

*Primary Examiner* — Shaun R Hurley
(74) *Attorney, Agent, or Firm* — Dority & Manning, P.A.

(57) ABSTRACT

A method is performed at a spinning machine that includes a plurality of spinning stations at which different yarn lots are spun. The method transports tubes from multiple tube magazines to the spinning stations. At the spinning station, a yarn is spun from a sliver deposited in a can and is wound onto the tube. An identical marking associated with a respective one of the different yarn lots is provided on the following components: each of the tubes, each of the tube magazines, a display device at the spinning station, a monitor at a machine control system, the cans at the spinning station, and a service unit that travels alongside of the spinning stations.

11 Claims, 2 Drawing Sheets

(56) References Cited

U.S. PATENT DOCUMENTS

| | | | | | |
|---|---|---|---|---|---|
| 5,269,478 | A * | 12/1993 | Wakabayashi | B65H 67/063 | 57/264 |
| 5,390,868 | A * | 2/1995 | Kiriake | B65H 67/063 | 198/340 |
| 5,443,217 | A * | 8/1995 | Nishikawa | D01H 9/18 | 57/264 |
| 6,056,228 | A | 5/2000 | Resch | | |
| 6,352,214 | B1 * | 3/2002 | Wild | B65H 75/182 | 57/265 |
| 2016/0168764 | A1 * | 6/2016 | Bungter | B65H 54/70 | 362/89 |

FOREIGN PATENT DOCUMENTS

| | | | | | |
|---|---|---|---|---|---|
| DE | 4216286 | A1 * | 12/1993 | B65H 67/063 | |
| DE | 42 44 123 | A1 | 6/1994 | | |
| DE | 10 2020 108 339 | A1 | 9/2021 | | |
| EP | 0342527 | A1 * | 11/1989 | B65H 67/063 | |
| EP | 0 593 808 | A1 | 4/1994 | | |
| EP | 0 916 614 | A2 | 5/1999 | | |

* cited by examiner

METHOD AT A SPINNING MACHINE AND SPINNING MACHINE

FIELD OF THE INVENTION

The present invention relates to a method at a spinning machine that includes a plurality of spinning stations at which different yarn lots are spun, wherein a tube is transported by means of a transport device from one of multiple tube magazines to the spinning station and, there, a yarn is spun from a sliver deposited in a can and, thereafter, the yarn is wound onto a tube. The invention also relates to a spinning machine that includes a plurality of spinning stations at which different yarn lots are spun, multiple tube magazines, and a transport device for transporting a tube from one of multiple tube magazines to the spinning station, and that includes a can and a sliver deposited in the can in order to spin a yarn from the sliver at the spinning station and, thereafter, wind the yarn onto a tube.

BACKGROUND

EP 0 916 614 A2 describes a central magazine for a tube feed unit of a textile machine that produces cross-wound bobbins and includes a storage unit for accommodating a plurality of tubes and a tube transfer unit for transferring the tubes to a machine-length transport unit. Multiple tube magazines are arranged, as storage columns, in the storage unit, the tube magazines being characterized by different colors. The tube magazines are therefore also suitable for textile machines that operate in a multiple-lot operation. The risk that the storage columns of the storage unit are accidentally loaded with incorrect empty tubes by the operating personnel is additionally minimized due to the fact that a mounting unit is arranged above each storage column, on which a pattern of the tube required in the relevant storage column is displayed.

It is disadvantageous that a duplicate labeling of the storage columns is necessary and that it is nevertheless unclear to the operator as to which lot and to which spinning station the tubes belong. Incorrect assignments of the tubes to individual lots can therefore take place anyway and result in great losses due to unacceptable qualities in the spinning process.

SUMMARY OF THE INVENTION

A problem addressed by the present invention is that of eliminating disadvantages known from the prior art, in particular of simplifying the operation of the machine and of improving the quality of the produced yarn lots. Additional objects and advantages of the invention will be set forth in part in the following description, or may be obvious from the description, or may be learned through practice of the invention.

The problem is solved using a method and a spinning machine having the features of the invention described and claimed herein.

The invention provides a method at a spinning machine that includes a plurality of spinning stations at which different yarn lots are spun, wherein a tube is transported by means of a transport device from one of multiple tube magazines to the spinning station and, there, a yarn is spun from a sliver deposited in a can and, thereafter, the yarn is wound onto a tube. According to the invention, the tube magazine and at least one or multiple of the following elements: tubes in the magazine, display device at the spinning station, monitor at a machine control system, can at the spinning station, service unit, are provided with an identical marking associated with the yarn lot.

If each of the tube magazines is provided with an appropriate marking and, in addition, one further typical component of the spinning machine is also provided with the same marking, a fast automatic or visual check of the spinning machine with respect to the correct assignment of the tubes to this further component can be carried out very easily and quickly. Provided that it is determined that the markings deviate from one another, this is an indication, for example, that incorrect tubes were delivered at the spinning station or an incorrect can is present and the spinning process is to be immediately interrupted.

The further component can be, for example, the tube in the magazine. The marking of this tube must be identical to the marking of the tube magazine. As a result, the filling of the tube magazine is also considerably simplified for the operator. The operator can orient him/herself at the same markings and fill the tube magazine accordingly. Due to a display of the marking at a display device at the spinning station, it can be checked whether the correct tube is located at the spinning station when the tube also has this marking and/or when this is the tube that comes from the tube magazine having the same marking.

On the other hand, when there is an identical marking on the can and on the display, it can be checked at the spinning station whether the correct can having the correct fiber material is located at the spinning station.

If the marking is located on a monitor of the machine control system, it is also possible that a certain yarn lot can be assigned to the tube magazine. As a result, the input of certain parameters that are necessary for producing the yarn lot can be carried out very easily and without getting mixed up with another yarn lot.

When the service unit is appropriately marked, it can also be very quickly and easily checked whether the service unit has the settings necessary for the yarn lot and, therefore, can carry out correct servicing, such as, for example, cleaning the spinning station or changing the tube, which has been completely wound to form a package, or exchanging this full tube with a new empty tube. At a spinning machine on which different yarn lots are simultaneously spun and, therefore, the service unit needs different settings, the check whether the setting at the spinning station currently being serviced is correct can be reliably carried out.

Due to all these possibilities for checking, which are carried out either by sensors or by the operators, it is ensured that the yarn lots are not mixed up and, thus, can be produced in a single-type manner.

It is advantageous when the marking is changed when the yarn lot is changed. The marking preferably corresponds to a certain yarn lot. If the yarn lot at the spinning station or at the tube magazine changes, a change of the marking is also an indication of this change and contributes to avoiding mix-ups.

It is also advantageous when the marking for the yarn lot is specified at the machine control system. At the machine control system, the specification of the marking can be carried out in a centralized manner. Which spinning station and which tube magazine are provided for the relevant yarn lot can therefore also be specified.

It is advantageous when the marking at the tube magazine, at the service unit, and/or at the spinning station is selected. The setting of the correct marking can be carried out easily and without error when the marking is carried out directly at the tube magazine, at the service unit, and/or at the spinning station, for example, by actuating a pushbutton or a switch.

It is very particularly advantageous when the assignment of the spinning stations to a yarn lot is carried out at the machine control system and/or directly at the spinning station. In particular, it is advantageous to assign the spinning station to a yarn lot at the machine control system, as a particularly good overview of the already assigned spinning stations and the remaining freely available spinning stations at the spinning machine is present at the machine control system and, therefore, an optimal distribution of the yarn lot to certain spinning stations can be carried out.

It is also advantageous when the assignment of the tube magazine to a yarn lot is carried out at the machine control system and/or directly at the tube magazine. This assignment of the tube magazine to a certain yarn lot is also preferably carried out at the machine control system or directly at the tube magazine. In particular, there is an overview of tube magazines that are still available and have not yet been loaded by other yarn lots.

It is also advantageous when the assignment of the tube magazine to a yarn lot, in particular the specification of the number of tube magazines needed for the yarn lot, is carried out by the machine control system. The information regarding the scope of the yarn lot is present at the machine control system, and so the specification of the number of tube magazines needed can be carried out most easily at the machine control system.

A spinning machine according to the invention has a plurality of spinning stations at which different yarn lots are spun. In addition, multiple tube magazines and a transport device are present in order to transport a tube from one of the multiple tube magazines to the spinning station. A sliver is deposited in a can in order to spin a yarn from the sliver at the spinning station and, thereafter, wind the yarn onto a tube to form a package. Each of the tube magazines and the tube in the magazine, a display device at the spinning station, a monitor at a machine control system, the can at the spinning station and/or a service unit are provided with an identical marking associated with the yarn lot.

Such a spinning machine has the advantage that the operation of the machine can be simplified and, therefore, the quality of the produced yarn lots can be improved. Frequently occurring faults, in which, for example, incorrect tubes are transported to the spinning station or the tube magazines are loaded with incorrect tubes, can be avoided as a result. It can be easily checked whether the correct tubes, the correct cans, or the correct parameters of the service unit are used in order to produce a certain yarn lot. This matching marking is extremely helpful, in particular, in the case of spinning machines in which a plurality of yarn lots can be simultaneously spun. The checking of the matching of the markings can be carried out by operators and also by sensors, which are arranged at the spinning machine and monitor the similarity of the markings.

It is also advantageous when the marking is a color, an icon, a pattern, a numeral, and/or text. In this way, it is possible, for example, that the individual different yarn lots are characterized by different colors. The pushbuttons, switches, bulbs, display devices, or monitors that are provided for a certain yarn lot can light up in the same color. It is also possible that a bulb is arranged at the can, which has this color of the corresponding yarn lot. Alternatively, it is also possible, for example, that the can has a colored rubber band, which is placed on the can according to the color of the yarn lot. Similarly, an icon, a pattern, a numeral, or text can be used instead of the different colors for marking the elements of the yarn lot. This can be carried out two- or three-dimensionally. In any case, it is essential that this marking is assignable to the same yarn lot.

It is advantageous when the marking is generated by a monitor or a display, in particular a color monitor, a bulb, in particular a multi-color LED, a switch, in particular a rotary switch having multiple positions, a pushbutton, in particular having color codes, and/or a label. A suitable marking means can be used depending on the type of element that is to be marked. It is advantageous that a monitor displays the appropriate marking, for example, at the spinning station and at the machine control system. It can be advantageous that a rotary switch, which is set to the appropriate position of the yarn lot, or a pushbutton, which lights up in the color of the yarn lot, is arranged at the tube loader. In contrast thereto, an appropriately marked label can be advantageous for marking the tubes.

Advantageously, sensors are arranged at the spinning machine for checking the markings. When it is determined by the sensors that the markings do not match, for example, a signal can be output to a control system, with which the continuation of the work on the yarn lot is suspended. The work is continued only when the error has been eliminated.

The device is designed according to the preceding description, wherein the aforementioned features can be present individually or in any combination.

BRIEF DESCRIPTION OF THE DRAWINGS

Further advantages of the invention are described in the following exemplary embodiments, wherein.

DETAILED DESCRIPTION

Figure 1:
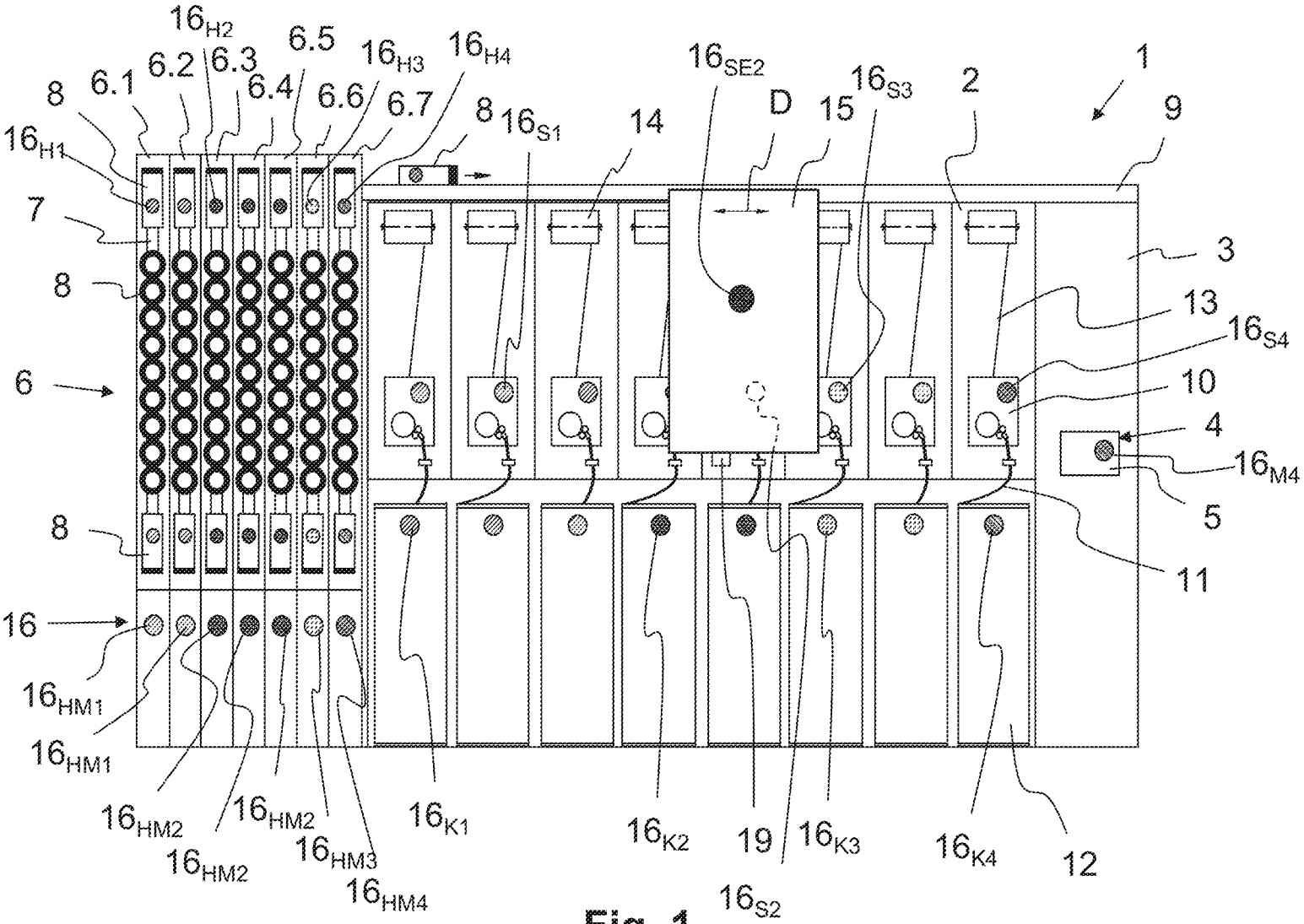
FIG. 1 shows a front view of a spinning machine.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

In the following description of the exemplary embodiments shown, the same reference signs are used for features that are identical and/or at least comparable in terms of their configuration and/or mode of operation, even though these are shown in different exemplary embodiments. Provided that the features are not described in detail again, their design and/or mode of operation correspond/corresponds to the design and mode of operation of the above-described features.

FIG. 1 shows a front view of a spinning machine 1, which has a plurality of spinning stations 2. An end stock 3, in which a machine control system 4 is located, is arranged at one end of the spinning machine 1. The machine control system 4 includes a monitor 5, via which conditions of the spinning machine 1 can be displayed and queried. In addition, settings of the spinning machine 1, in particular with respect to various yarn lots, can be carried out via the monitor 5.

A plurality of tube magazines 6.1 through 6.7 is arranged at the other end of the spinning machine 1. In this exemplary embodiment, each tube magazine 6.1 through 6.7 has a chain 7, which stores a plurality of tubes 8. The chain 7 is driven and can move a tube 8 to a delivery point (not shown), at which the tube 8 is removed from the chain 7 and is placed onto a transport belt 9 in order to transport the tube 8 to a predetermined spinning station 2. Such a tube 8 on the transport belt 9 is shown by way of example. The tube 8 is moved in the arrow direction together with the transport belt 9.

A spin box 10 is arranged at each spinning station 2. A sliver 11, which is deposited in a can 12 at the spinning station 2, is fed to the spin box 10 and, there, is spun to form a yarn 13. Thereafter, the yarn 13 is wound onto a package 14. As soon as the package 14 has a predetermined size, the package 14 is removed from the spinning station 2 by a service unit 15 and replaced by an empty tube 8 delivered by the transport belt 9. Thereafter, yarn 13 is wound on the empty tube 8 again. After the package 14 has been replaced by an empty tube 8 and, if necessary, further servicing has been carried out, the service unit 15 is moved in the direction of the double arrow D along the spinning machine 1 to another spinning station 2 at which service is required.

Figure 4:
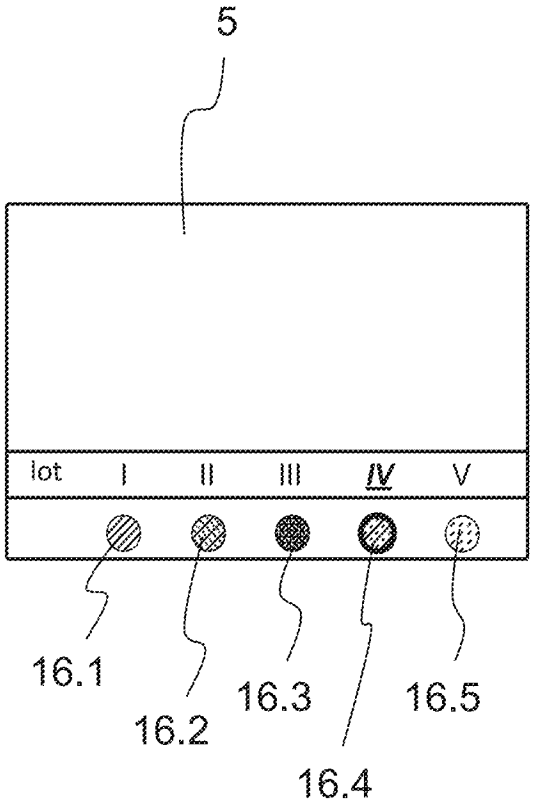
FIG. 4 shows a monitor of the machine control system.

At the spinning machine 1, different yarn lots, for example, five different yarn lots I through V according to FIG. 4, can be produced using different yarns 13. In principle, it is possible that a different yarn 13 is produced at each spinning station 2. The different yarns 13 are wound onto different tubes 8 so that the yarns 13 can be subsequently identified. Which yarn lot is on the tube 8 or the package 14 can be subsequently identified on the basis of the type of the tube 8. If a certain yarn 13 is accidentally wound onto an incorrect tube 8, this yarn 13 would be subsequently assigned to an incorrect yarn lot. This yarn 13 would therefore be a reject. The same problem would arise when an incorrect can 12 is positioned at a spinning station 2. In this case, an incorrect sliver 11 in the spinning station 2 would be spun to form a yarn 13, which also does not correspond to the specification of this yarn lot. This would also be a reject. Similarly, it is important for the service unit 15 to know the spinning station 2 at which it is located, which yarn lot is being spun and, therefore, which parameter settings in the service unit 15 must apply in order to be able, for example, to piece the relevant yarn 13.

It is provided to use corresponding markings in order to be able to ensure that the correct tubes 8 are arranged in the tube magazine 6, that the correct cans 12 are also present at the appropriate spinning stations 2, and that the service unit 15 also carries out the servicing at the spinning station 2 with the correct parameters and, finally, that the individual yarn lots can be specified in the machine control system 4. For example, a marking (in this case, $\mathbf{16}_{HM1}$ through $\mathbf{16}_{HM4}$ for four different yarn lots I through IV) is arranged at each of the tube magazines 6.1 through 6.7. This marking $\mathbf{16}_{HM1}$ through $\mathbf{16}_{HM4}$ matches the marking $\mathbf{16}_{H1}$ through $\mathbf{16}_{H4}$ at the tubes 8 in the particular tube magazine 6.1 through 6.7. The cans 12 also have markings $\mathbf{16}_{K1}$ through $\mathbf{16}_{K4}$, which must correspond to a marking $\mathbf{16}_{S1}$ through $\mathbf{16}_{S4}$ at the spinning station 2. Depending on the spinning station 2 at which the service unit 15 is located for its work, the service unit 15 in this exemplary embodiment also has an appropriate marking $\mathbf{16}_{SE2}$, which corresponds to the spinning station 2 and its marking $\mathbf{16}_{S2}$ at a display unit of the spinning station 2 and the marking $\mathbf{16}_{K2}$ at the can 12. The machine control system 4 or its monitor 5 also has a marking ($\mathbf{16}_{M4}$ in this case) for configuring the individual yarn lots. At the machine control system 4, the marking (e.g., $\mathbf{16}_{M4}$) can be assigned to a certain yarn lot, and parameters, such as, for example, spinning speed, yarn count, yarn amount, etc., of this yarn lot can be specified.

Different markings 16, each of which is assigned to a certain yarn lot, are provided for distinguishing the individual yarn lots. Symbolically, circles are shown in FIG. 1, each of which is filled with an appropriate pattern as a marking 16. The marking can also be a bulb, for example, an LED, which lights up in a certain color. It is also possible that the marking 16 is a certain text, a barcode, a colored or patterned rubber band around the can, or the like. The type of marking can also differ, the only important point being that the marking have an unambiguous common feature, such as, for example, the same color. Markings 16 at the tubes 8 are preferably applied in such a way that the markings 16 are still recognizable after the yarn 13 has been wound onto the tubes 8 and, thus, the markings 16 simultaneously characterize the package 14. As is also apparent from FIG. 1, the two tube magazines 6.1 and 6.2 on the left are provided with the same marking $\mathbf{16}_{HM1}$ and, thus, belong to the same yarn lot 1. The same applies for the three tube magazines 6.3 through 6.5 in the middle. The three tube magazines 6.3 through 6.5 in the middle are also characterized by the same markings $\mathbf{16}_{HM2}$ and, therefore, refer to a further yarn lot II. The tube magazines 6.6 and 6.7 are assigned to different yarn lots Ill and IV and, accordingly, have markings $\mathbf{16}_{HM3}$ and $\mathbf{16}_{HM4}$. Corresponding markings $\mathbf{16}_{H1}$, $\mathbf{16}_{H2}$, $\mathbf{16}_{H3}$, and $\mathbf{16}_{H4}$ are applied at the tubes 8 in the tube magazines 6. Corresponding markings 16 are located, again, at the corresponding cans 12 and spinning stations 2. Once the service unit 15 is currently working at a spinning station 2 having the can marking $\mathbf{16}_{K2}$, the service unit 15 is also provided with the marking $\mathbf{16}_{SE2}$.

As is also apparent from the representation, the number of tube magazines 6 or spinning stations 2 assigned to the particular yarn lots can deviate from each other. The assignment can be made via the machine control system 4 and depends, for example, on the production speed of the spinning stations 2 and the size of the particular yarn lot.

The markings 16 that are present can be checked by means of a sensor 19, which is shown in this case, for example, at the service unit 15. If an error is detected, the sensor 19 transmits an appropriate signal to a control system.

Figure 2:
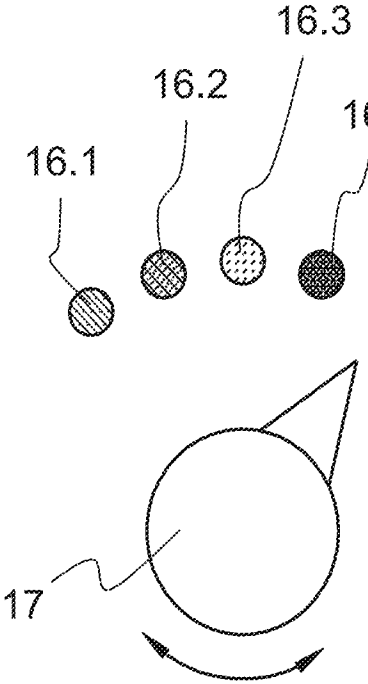
FIG. 2 shows a rotary switch.

A rotary switch 17 is symbolically represented in FIG. 2. The rotary switch 17 can be set to a certain marking 16.1 through 16.5. Such a rotary switch 17 is arranged, for example, at the tube magazine 6 and effectuates an appropriate assignment of the tube magazine 6 to a certain yarn lot. Due to the setting of the rotary switch 17, a signal can be connected to the machine control system 4, as the result of which it is specified that the relevant tube magazine 6 is assigned precisely to this selected yarn lot and, when a tube 8 from this yarn lot is requested, the appropriate tube magazine 6 is activated for delivering the tube 8.

Figure 3:
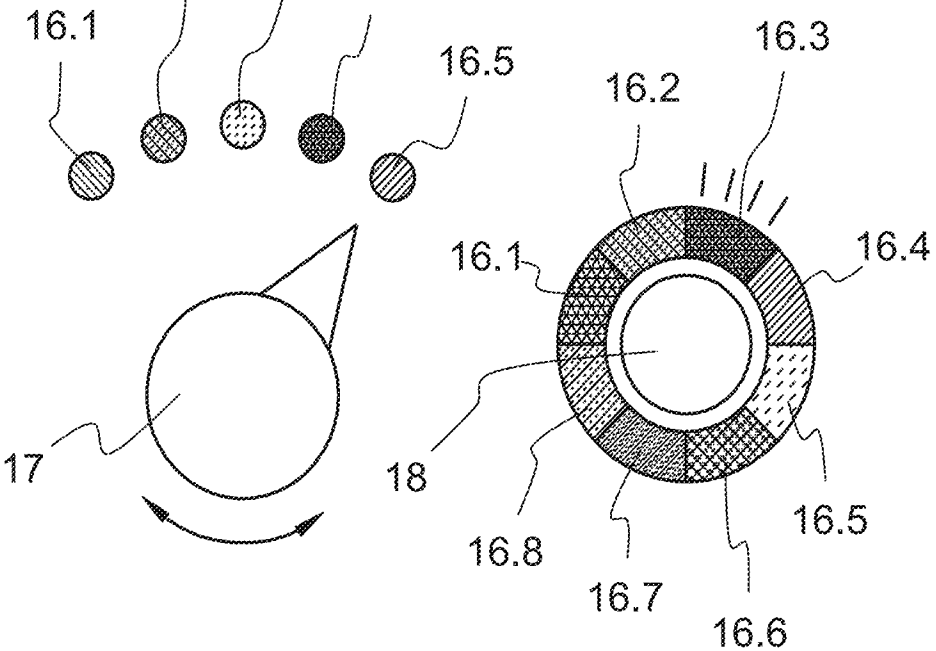
FIG. 3 shows an illuminated jog button.

FIG. 3 symbolizes a pushbutton 18. The pushbutton 18 can activate different markings 16, specifically marking 16.3 in this case, by being pressed multiple times. It is possible that different bulbs light up or that the pushbutton 18 activates a multi-color LED and the appropriate color lights up. In this exemplary embodiment, eight different lots are possible, and so eight different markings 16.1 through 16.8 are settable.

FIG. 4 schematically shows the monitor 5 of the machine control system 4. At the monitor 5, the markings 16 can be selected and these markings 16 can be assigned to certain lots. The lot for which the parameters are to be changed, namely lot IV in this case, which is shown in bold, can also be determined.

The present invention is not limited to the represented and described exemplary embodiments. Modifications within the scope of the claims are also possible, as is any combination of the features, even if they are represented and described in different exemplary embodiments.

LIST OF REFERENCE SIGNS

1 spinning machine
2 spinning station
3 end stock
4 machine control system
5 monitor
6 tube magazine
7 chain
8 tube
9 transport belt
10 spin box
11 sliver
12 can
13 yarn
14 package
15 service unit
16 marking
17 rotary switch
18 pushbutton
19 sensor

The invention claimed is:

1. A method performed at a spinning machine that includes a plurality of spinning stations at which different yarn lots are spun, comprising:

transporting tubes by means of a transport device from multiple tube magazines to the spinning stations;

at each spinning station, spinning a yarn from a sliver deposited in a can, and winding the yarn onto the tube at the respective spinning station; and providing an identical marking associated with a respective one of the different yarn lots on the following components: each of the tubes, each of the tube magazines, a display device at the spinning station, a monitor at a machine control system, the cans at the spinning stations, and a service unit that travels alongside of the spinning stations.

2. The method of claim 1, comprising changing the marking on the components when changing the yarn lot produced at the spinning stations.

3. The method of claim 1, wherein the marking for each of the yarn lots is specified at the machine control system.

4. The method of claim 1, wherein the marking is selected directly at the tube magazines, at the service unit, or at the spinning stations.

5. The method of claim 1, wherein assignment of the spinning stations to a particular yarn lot is carried out at the machine control system or directly at each spinning station.

6. The method of claim 1, wherein assignment of the tube magazines to a particular yarn lot is carried out at the machine control system or directly at each tube magazine.

7. The method of claim 1, wherein assignment of a number of the tube magazines to a particular yarn lot is carried out by the machine control system.

8. A spinning machine, comprising:

a plurality of spinning stations at which different yarn lots are spun;

multiple tube magazines in which tubes are stored;

a transport device that transports the tubes from the tube magazines to the spinning stations;

a can at each spinning station having a sliver deposited therein, wherein a yarn is spun at the spinning station from the sliver and wound onto the tube at the respective spinning station;

a service unit that travels alongside of the spinning stations;

a machine control system;

an identical marking associated with each of the different yarn lots provided on the following: each of the tubes, each of the tube magazines, a display device at each spinning station, a monitor at the machine control system, the cans at the spinning stations, and the service unit.

9. The spinning machine of claim 8, wherein the marking comprises a color, an icon, a pattern, a numeral, or text.

10. The spinning machine of claim 8, wherein the marking is generated by a display, a bulb, a multi-position switch, a pushbutton, a colored band, or a label.

11. The spinning machine of claim 8, further comprising sensors configured to check agreement between the markings at the spinning machine.

* * * * *